United States Patent [19]

Müller et al.

[11] Patent Number: 4,619,307

[45] Date of Patent: Oct. 28, 1986

[54] APPARATUS FOR COMPRESSING FOUNDRY MOULDING MATERIAL BY PRESSURE GAS

[75] Inventors: Günter Müller, Karlsruhe; Norbert Damm, Karlsdorf-Neuthard, both of Fed. Rep. of Germany

[73] Assignee: BMD Badische Maschinenfabrik Durlach GmbH, Karlsruhe, Fed. Rep. of Germany

[86] PCT No.: PCT/EP84/00392

§ 371 Date Aug. 2, 1985

§ 102(e) Date Aug. 2, 1985

[87] Pub. No.: WO 85/02568

PCT Pub. Date: Jun. 20, 1985

[21] Appl. No.: 767,274

[22] PCT Filed: Dec. 7, 1984

[30] Foreign Application Priority Data

Dec. 9, 1983 [DE] Fed. Rep. of Germany ..... 3344520

[51] Int. Cl.[4] ..... B22C 15/00

[52] U.S. Cl. ..... 164/169; 164/37

[58] Field of Search ..... 164/169, 170, 171, 195, 164/37, 38

[56] References Cited

U.S. PATENT DOCUMENTS

| | | | |
|---|---|---|---|
| 3,659,642 | 5/1972 | Vasilkovsky et al. | 164/37 X |
| 4,546,810 | 10/1985 | Landolt | 164/37 |
| 4,572,274 | 2/1986 | Zimmermann | 164/169 |

FOREIGN PATENT DOCUMENTS

| | | | |
|---|---|---|---|
| 2069384A | 8/1981 | United Kingdom | 164/169 |
| 665977 | 6/1979 | U.S.S.R. | 164/169 |
| 793696 | 1/1981 | U.S.S.R. | 164/169 |

*Primary Examiner*—Nicholas P. Godici
*Assistant Examiner*—J. Reed Batten, Jr.
*Attorney, Agent, or Firm*—Antonelli, Terry & Wands

[57] ABSTRACT

In an apparatus for compressing foundry moulding material by pressure gas comprising a pressure vessel for the pressure gas forming an inlet pressure chamber, a moulding chamber positioned below it formed from moulding boxes with sand frames and a pattern plate with pattern on which the moulding material is loosely heaped up prior to compression and a large-area valve arranged between the pressure vessel and the moulding chamber, its closure member frees the valve opening in a few milliseconds, accompanied by the joint action of the pressure in the pressure vessel and thereby moves into the moulding chamber. The closure member is brought into the closed position by a pressure cylinder, whose piston is connected on the stroke side to a high pressure source and with its opposite side forms the movable termination of a gas-pressurized pressure reservoir, the high pressure side outflow being constructed in such a way that the pressure medium flows out at a speed of more than 10 m/s, accompanied by the simultaneous acceleration of the piston under the pressure in the pressure reservoir and the closure member into the open position.

12 Claims, 2 Drawing Figures

APPARATUS FOR COMPRESSING FOUNDRY MOULDING MATERIAL BY PRESSURE GAS

The invention relates to an apparatus for the compression of foundry moulding material by means of pressure or compression gas comprising a pressure vessel for the pressure gas forming an initial pressure chamber, a moulding chamber positioned below the pressure vessel and comprising a moulding box with a sand frame and a pattern plate with a pattern closing off the moulding box at the bottom and onto which the moulding material is loosely heaped up prior to compression and a large-area valve arranged between the pressure vessel and the moulding chamber and whose closure member releases the valve opening in a few milliseconds under the joint action of the pressure in the pressure vessel, moves into the moulding chamber and can be brought into the closed position by means of a pressure cylinder.

In U.S. Pat. No. 4,529,026, a process and an apparatus for compressing foundry moulding material, particularly moulding sand by means of pressure gas, e.g. compressed air or pressure gas produced by explosive combustion are described, the pressure gas being expanded in sudden bursts from a pressure vessel into the moulding chamber, whereby it acts on the free moulding material surface and compresses the moulding material particles accompanied by the reciprocal exchange of momentum, together with a delay of the accelerated moulding material mass on the top of the pattern and the pattern plate, fluidizing effects also occurring, accompanied by the reduction of particle friction. Importance is attached to a high gas mass throughput with the speediest possible pressure rise in the moulding chamber. The lower the initial pressure in the pressure vessel, the higher these parameters must be, initial pressure being sought which are in the range of the pressure of operational compressed air network, so that excessive constructional expenditure is not required for the pressure gas production or for controlling the pressure. Thus, the apparatus must have a closure member, which on the one hand closes a maximum cross-section for the overflow of the pressure gas and on the other hand has a minimum mass, in order to release the cross-section as rapidly as possible. This also requires opening drives, which bring the closure member into the open position in a few milliseconds and consequently release the cross-section. The aforementioned requirements cannot be satisfied by conventional valve constructions.

In an earlier-dated patent application (DE: No. P33 21 622.3, U.S. Pat. No. 617,920, JP: No. 59-122 180, EP: No. 84 10 6795.2), the pressure gradient between the pressure vessel and the moulding chamber is utilized for the opening of the valve, in that the closure member leads into the pressure vessel and its opening movement is directed into the moulding chamber. The closing drive for the closure member is a pressure cylinder, whose piston is connected to a guide rod of the closure member. In the closed position, the guide rod is fixed by means of a clamping device. At least during the opening movement, the pressure cylinder is disengaged from the guide rod so that it does not have to work against the pressure in the pressure cylinder. The drive connection is then restored again and the closure member is again brought back into the closed position by the guide rod.

The object of the present invention is to so further develop the previously described apparatus that, with minimum constructional expenditure, a still higher opening speed for the closure member is obtained.

According to the invention, this object is solved in that on the lift or stroke side, the piston of the pressure cylinder is connected to a high pressure source and with its opposite side forms the movable termination of a pressure reservoir subject to the action of the gas and that the high pressure side outflow is constructed in such a way that the pressure flows out at a speed of $>10$ m/s, accompanied by the simultaneous acceleration of the piston under the pressure in the pressure reservoir and the closure member into the open position.

In the case of the construction according to the invention, the pressure cylinder not only fulfils the closing function, but also the opening and damping function for the closure member. Thus, the clamping device and damping device required in the previously described apparatus are rendered superfluous.

Practical tests with the known apparatuses have shown that for medium size moulding boxes, the pressure build-up over the moulding material surface must take place with a pressure gradient of approximately 200 to 300 bar/s, in order to ensure a completely satisfactory compression. This leads to a closure member speed exceeding 1/s in the case of a large-area closure member with an optimized low mass and an initial pressure of the type prevailing in plant-internal compressed air networks. If, in accordance with the present invention, the opening movement is aided by the pressure cylinder used for closing the closure member, for a given pressure in the pressure reservoir, this presupposes high outflow speeds for the pressure volume displaced during the piston opening movement. According to the invention, this outflow speed must be $>10$ m/s, i.e. in a range which is higher by a factor of 10 than the return oil speeds conventionally used in hydraulics. This much higher outflow speed for the displacement volume can be achieved through corresponding constructional measures. The piston speed only reaches values in the range of approximately 5 m/sec.

According to a first embodiment, the pressure cylinder has on the stroke side a small displacement volume of e.g. 150 to 500 $cm^3$. The smaller the displacement volume, the shorter can be the outflow time or the stroke time for given cross-sections.

According to a further embodiment, the high pressure side outflow is connected from the high pressure circuit and is connected to a drain tank via a relatively large cross-section line. This embodiment on the one hand keeps the flow resistance for the outflowing displacement volume as small as possible and on the other hand the disconnection from the high pressure circuit ensures that the pressure quantity to be displaced is small. The drain tank provides the possibility of obtaining a rapid pressure reduction on the outflow side.

In practice, a pressure between 100 and 300 bar has proved appropriate for the high pressure source and these pressures can be achieved without difficulty in hydraulics.

The pressure reservoir, whose pressure acts on the other side of the piston, is under a gas pressure between 50 and 200 bar when the closure member is in the closed position, i.e. in the raised end position of the piston and said pressure acts directly or indirectly, e.g. via a hydraulic cushion on the piston. As from about 50 bar, the effect of a gas pressure cushion, which in principle is already present at lower pressures, acts in a very advantageous manner in the sense of an additional acceleration.

It has also proved to be advantageous if the ratio of the pressure reservoir volume and displacement volume of the pressure cylinder is at least 5:1.

Practical tests with the apparatus according to the invention have shown that the opening speed of the closure member can be roughly doubled, leading to a considerable reduction in the constructional expenditure.

The apparatus according to the invention is also characterized by a constrictor or throttle acting towards the end of the piston lowering movement and which ensures that the piston and consequently the closure member are decelerated over a short distance.

According to a preferred construction, the piston rod connecting the piston to a closure member has within the pressure cylinder a portion which widens conically opposite the cylinder passage of the piston rod and that the piston rod passes through the inflow and outflow port of the cylinder chamber forming the throttle in conjunction with the conically widened portion of the piston rod. The damping behaviour can be further optimized by axially directed notches additionally worked into the conical shoulder. Thus, the throttle braking the piston is integrated into the pressure cylinder.

According to another embodiment, a maximum speed performance is aided in that the inflow and outflow port of the cylinder chamber forming part of the throttle issues into at least two inflow and outflow ducts.

According to another feature of the invention the piston has a lug projecting into the pressure reservoir area and said lug is provided with a stop cooperating with an end position limiter for the piston lowering movement.

According to a preferred construction, the high pressure source is connected via a control slide valve, a check valve and a line branching off behind the same with the two ducts of the pressure cylinder and that the drain tank is connected to the branch lines via a controllable check valve. Thus, as intimated hereinbefore, the branch lines have a maximum cross-section, to permit a rapid outflow of the pressure medium.

Finally, according to another embodiment, the control slide valve connects the pressure cylinder to the high pressure source in a first position and opens the control line of the controllable check valve, so that the latter closes and in a second position connects the control line to the high pressure source, so that the check valve opens against the pressure in the branch line and connects the pressure cylinder to the drain tank.

Hereinafter, the invention is described by means of an embodiment shown in the drawings, wherein.

Figure 1:
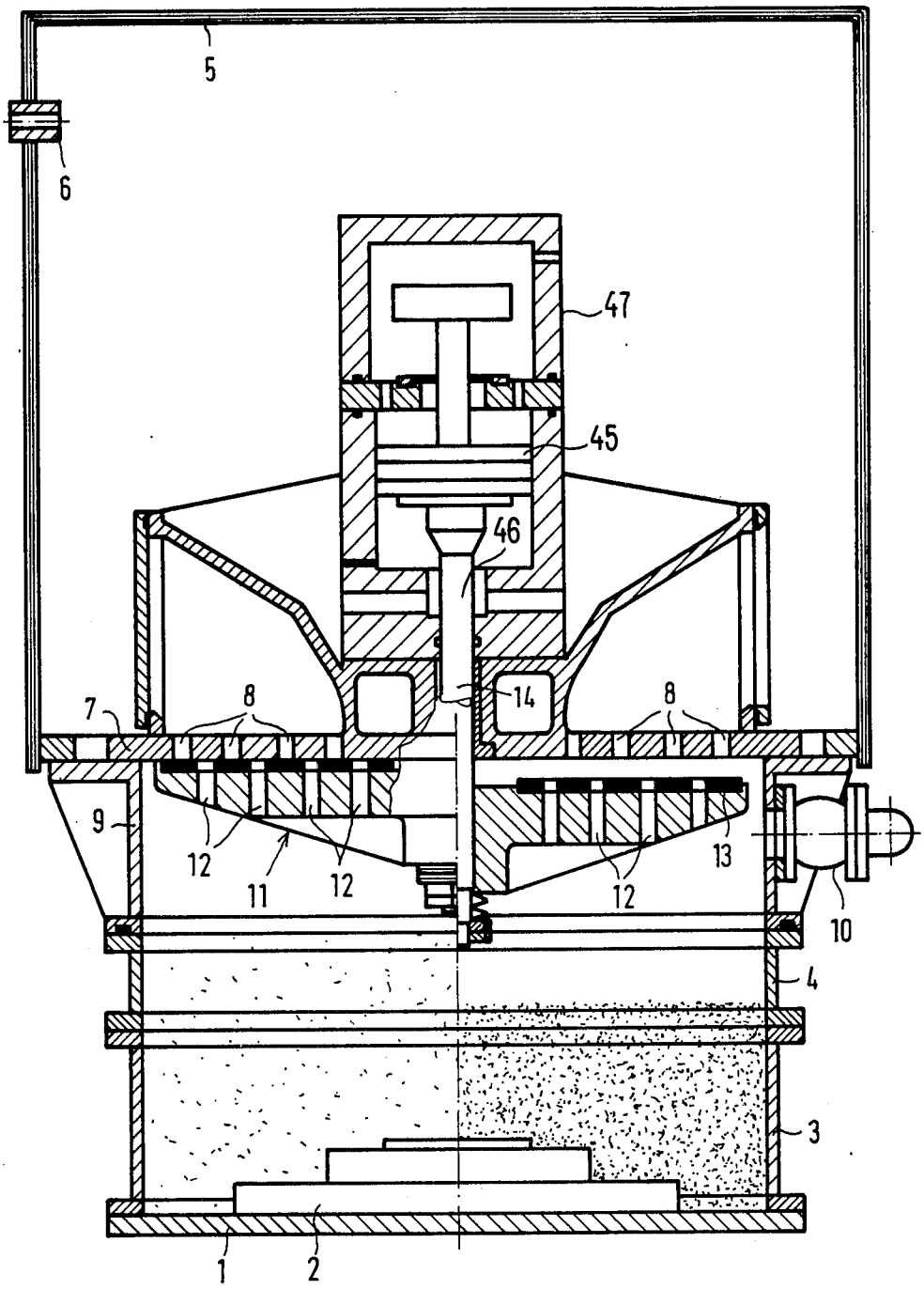
FIG. 1 is a section through an embodiment of the apparatus.

The drawings only show those parts of the compression apparatus of a foundry moulding machine necessary for the understanding of the invention. In particular, the following are not shown: the upright, the device for raising and lowering the moulding boxes and sand frames, as well as optionally for ejecting the finished mould from the moulding box. The devices for bringing up the pattern and for filling the moulding sand are also not shown, because they are known in foundry mechanical engineering.

On a pattern plate 1 with a pattern 2 is located a moulding box 3 and on the latter a sand frame 4. Above the moulding chamber is provided a pressure vessel 5 and in the represented embodiment this receives compressed air and is connected via a connection 6 supplied from a pressure reservoir or, in the case of a low inlet pressure, from the operational compressed air network.

The base 7 of the pressure vessel is constituted by a plate, which is provided in grating-like manner above the moulding chamber with a plurality of openings 8. To the bottom of base 7 is flanged a frame 9, to which is in turn connected a spent airline with a valve 10. The pressure vessel 5 with frame 9 on the one hand and pattern plate 1 with pattern 2, moulding box 3 and sand frame 4 on the other are movable with respect to one another to permit the filling of the moulding chamber with the moulding material. Prior to compression, these two subassemblies are brought together and tightly pressed together at their joint base.

A closure member in the form of a rigid valve plate 11, which also has a plurality of openings 12, cooperates with the base 7 or its area having openings 8. There is also a sealing layer 13 on the top of the valve plate within the region of openings 12, as well as the openings 8 in base 7. As can be seen from the left-hand half of the drawing, the openings 8 in base 7 and the openings 12 in valve plate 11 are so displaced with respect to one another that they do not overlap in the closed position.

Figure 2:
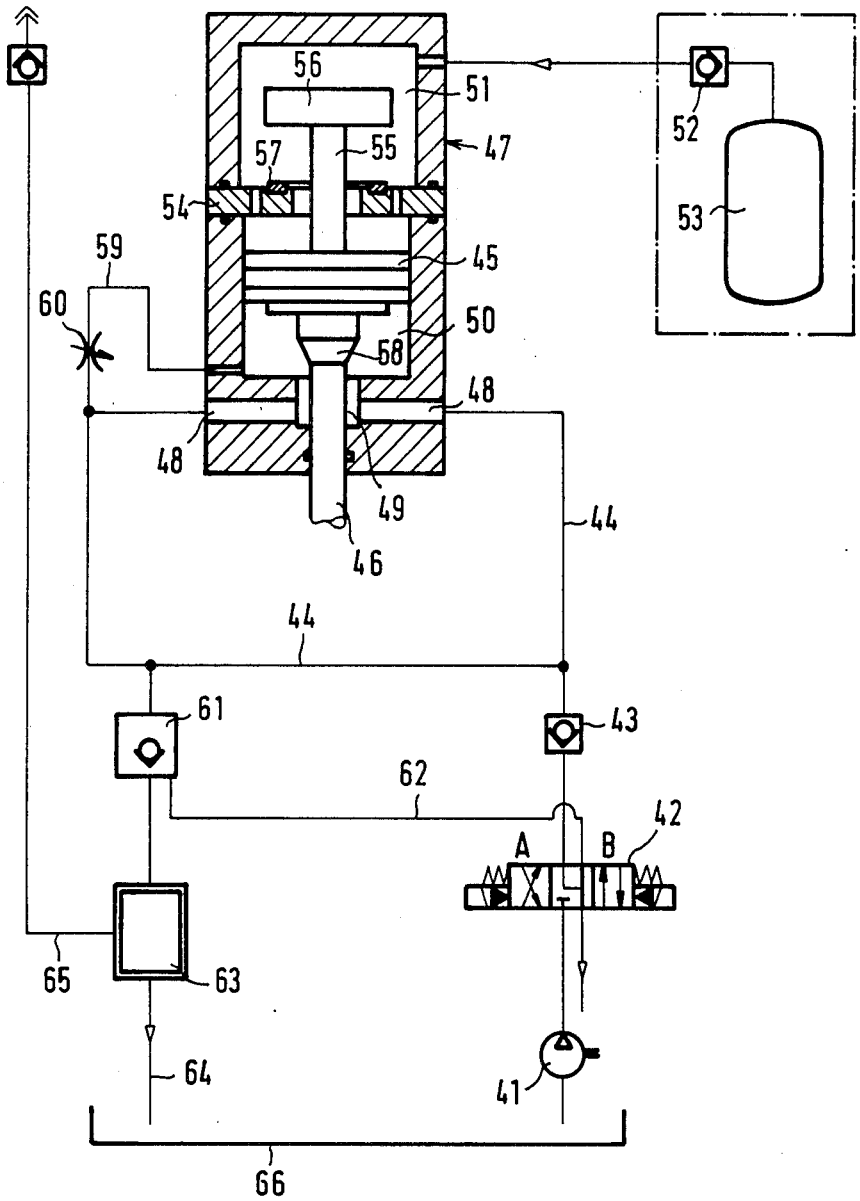
FIG. 2 is an embodiment of the pressure cylinder control system.

Valve plate 11 is located on a guide rod 14, which passes into the piston rod 46 of piston 45 of a pressure cylinder 47. This will be described hereinafter relative to FIG. 2.

The pressure cylinder 47 is arranged in a high pressure circuit, the high pressure source being 41. This is e.g. a hydraulic pump, which is supplied by a tank 66. From high pressure source 41 the pressure medium passes via a control slide valve 42 and a check valve 43 into branch lines 44, each of which is connected to a duct 48 in pressure cylinder 47. The ducts 48 issue into a central opening 49 of the pressure cylinder, which forms the connection to the working area 50 of the pressure cylinder. The latter is provided, above piston 45, with a pressure reservoir 51, which is connected via a check valve 52 to a gas-pressure receiver 53. Piston 45 forms the lower, movable termination of the pressure reservoir 51 which contains a partition 54, which forms an end position limitation for piston 45 and consequently closure member 11. Partition 54 is provided with a plurality of openings, so that the pressure in the pressure reservoir 51 can act in unimpeded manner on piston 45. The piston is in turn connected via a lug 55 with a stop 56, which in the lower end position of piston 45, i.e. in the open position of closure member 11, rests on an elastic element 57.

In its region located within the working area 50, piston rod 46 is provided with a conically widened portion 58 which, in conjunction with opening 49, forms a type of restrictor or throttle during the lowering movement of piston 45. The working area 50 of pressure cylinder 47 can also be connected via a line 59 to a further precision throttle 60, which is in turn connected to one of the two branch lines 44.

The branch lines 44 are connectable via a controllable check valve 61, whose control line 62 can be connected via control slide valve 42 to the high pressure source 41, to a drain tank 63, whose outflow 64 issues into the system tank 66 and which is also provided with a vent 65.

The function of the apparatus will now be described. In order to bring the closure member 11 out of the open position shown to the right in FIG. 1 into the closed position in the left-hand half thereof, the control slide valve 42 is brought into position "B", where the connection between high pressure source 41 and the working area 50 of pressure cylinder 47 is formed, accompanied by the opening of check valve 43. At the same time, the control line 62 of the controllable check valve 61 is connected to the system tank, i.e. in pressureless manner, so that the check valve 61 closes. The pressure medium flows via branch lines 44 and ducts 48 into the working area 50, raises the piston 45 and consequently the piston rod 46 and the guide rod 14 with closure member 11 until the latter finally reaches the closed position in the left-hand half of FIG. 1. Before or during this process the pattern plate 1 with the filled moulding box 3 and sand frame 4 are braced with the frame 9. Valve 10 is in the closed position. During the raising of piston 45 which e.g. takes place under a pressure of approximately 250 bar, the medium in the pressure reservoir 41 is simultaneously pressurized. Possible leakage losses in pressure reservoir 51 are supplemented by the pressure receiver 53. The pressure in the pressure reservoir 51 e.g. rises to approximately 100 bar.

For the burst-like expansion of pressure vessel 5 and for compressing the moulding material in the moulding box and sand frame, the closure member 11 is brought into the open position (right-hand half of FIG. 1), for which purpose the control slide valve 42 is switched over into position "A". The pressure of the high pressure source 41 then prevails in control line 62, so that the check valve 61 opens. Over the relatively large outflow cross-sections of opening 49, ducts 48 and branch lines 44, the pressure medium flows out of the working area 50 under the action of the pressure in pressure reservoir 51 via check valve 61 into drain tank 63. Towards the end of the lowering movement of piston 45, the drain cross-section between piston rod 46 and outflow port 49 is reduced by the conical portion 58 on piston rod 46, so that the piston 45 and consequently closure member 11 are decelerated. During the opening movement, the pressure medium to be displaced flows out of the working area 50 at a speed of more than 10 m/s and preferably between 20 and 30 m/s.

The drain tank 63 can be vented between the compression stroke via line 65, so that its content can flow out into the system tank 66.

We claim:

1. Apparatus for the compression of foundry moulding material by means of pressure or compression gas comprising a pressure vessel for the pressure gas forming an initial pressure chamber, a moulding chamber positioned below the pressure vessel and comprising a moulding box with a sand frame and a pattern plate with a pattern closing off the moulding box at the bottom and onto which the moulding material is loosely heaped up prior to compression and a large-area valve arranged between the pressure vessel and the moulding chamber and whose closure member releases the valve opening in a few milliseconds under the joint action of the pressure in the pressure vessel, moves into the moulding chamber and can be brought into the closed position by means of a pressure cylinder, characterized in that on the lift or stroke side, the piston (45) of the pressure cylinder (47) is connected to a high pressure source (41) and with its opposite side forms the movable termination of a pressure reservoir (51) subject to the action of the gas and that the high pressure side outflow (44, 48, 61, 64) is constructed in such a way that the pressure flows out at a speed of $>10$ m/s, accompanied by the simultaneous acceleration of the piston (45) under the pressure in the pressure reservoir (51) and the closure member (11) into the open position.

2. Apparatus according to claim 1, characterized in that on the stroke side, the pressure cylinder (47) has a small displacement volume of between 150 and 500 $cm^3$.

3. Apparatus according to claim 1, characterized in that the high pressure side outflow (44, 48, 49) is disconnected by means of switching elements (61, 43) from the high pressure source (41) and is connected by means of a line (44) having a relatively large cross-section to a drain tank (63).

4. Apparatus according to one of the claims 1 to 3, characterized in that the pressure of the high pressure source (41) is between 100 and 300 bar.

5. Apparatus according to claim 1, characterized in that the pressure reservoir (51) in the closed position of closure member (11) is directly or indirectly under a gas pressure between 50 and 200 bar.

6. Apparatus according to claim 1, characterized in that a ratio of a pressure reservoir volume and a displacement volume of the pressure cylinder (47) is at least 5:1.

7. Apparatus according to claim 1, characterized in that the piston (45) has a lug (55) projecting into the area of the pressure reservoir (51) and which has a stop (56) cooperating with an end position limiter (54, 57) for a lowering movement of piston (45).

8. Apparatus according to claim 1, characterized by a throttle (49, 58, 59, 60) acting towards an end of a lowering movement of piston (45).

9. Apparatus according to claim 8, characterized in that a piston rod (46) connecting the piston (45) of the closure member (11) has, within the pressure cylinder (47), a portion (58) which widens conically opposite to the cylinder passage and that the piston rod (46) passes through the supply and discharge port (49) of cylinder chamber (50) and which, in conjunction with the conically widened portion (58) of piston rod (46), forms the throttle.

10. Apparatus according to claim 1, characterized in that the supply and discharge port (49) of cylinder chamber (50) communicates with at least two supply and discharge ducts (48).

11. Apparatus according to claim 10, characterized in that the high pressure source (41) is connected via a control slide valve (42), a check valve (43) and a branch line (44) to the at least two supply and discharge ducts (48) of the pressure cylinder (47) and that a drain tank (63) is connected to the branch line (44) via a controllable check valve (61).

12. Apparatus according to claim 11, characterized in that the control slide valve (42) in a first position connects the pressure cylinder (47) to the high pressure source (41) and pressure-relieves a control line (62) of a controllable check valve (61), so that the latter closes, and in a second position, connects the control line (62) to the high pressure source (41), so that the check valve (61) opens counter to the pressure in branch line (44) and connects the pressure cylinder (47) to drain tank (63).

* * * * *